US005438931A

United States Patent [19]

Becker et al.

[11] Patent Number: 5,438,931

[45] Date of Patent: Aug. 8, 1995

[54] RAIL ANCHOR REMOVER

[75] Inventors: Neal W. Becker, Milwaukee; Jeffrey S. Hon, Waterford; Robert L. Turner, Racine, all of Wis.

[73] Assignee: Racine Railroad Products, Inc., Racine, Wis.

[21] Appl. No.: 172,116

[22] Filed: Dec. 22, 1993

[51] Int. Cl.[6] ..... E01B 29/00

[52] U.S. Cl. ..... 104/17.2

[58] Field of Search ..... 104/17.2, 9, 2; 29/426.5, 426.6, 402.08, 244, 270

[56] References Cited

U.S. PATENT DOCUMENTS

| | | | |
|---|---|---|---|
| 3,135,222 | 6/1964 | D'Angelo | 104/17.2 |
| 3,722,422 | 3/1973 | Chandre et al. | 104/17.2 |
| 4,319,392 | 3/1982 | Cutts | 104/17.2 |
| 4,580,501 | 4/1986 | Collins et al. | 104/17.2 |
| 4,890,558 | 1/1990 | Quella et al. | 104/17.2 |
| 4,903,611 | 2/1990 | Holley | 104/17.2 |
| 5,074,219 | 12/1991 | Theurer et al. | 104/17.2 |
| 5,117,760 | 6/1992 | Almaraz et al. | 104/17.2 |

*Primary Examiner*—Mark T. Le

*Attorney, Agent, or Firm*—Nilles & Nilles

[57] ABSTRACT

An anchor removing machine is capable of automatically removing anchors from a rail and of windrowing the removed anchors between rails. The machine preferably employs a ram assembly to detach the tail of the anchor from the rail, a field side kicker assembly to drive the anchor towards the gauge side of the rail in order to facilitate anchor removal, and a windrow assembly to engage the head of the anchor and to pull the anchor away from the gauge side of the rail for subsequent pick up. Lateral and vertical alignment between the anchor removing machine and the anchor is assured by opposed plates and by stops, respectively. Preferably, pressure switches or the like prevent the operation of each component in the system until operation of the preceding component is completed.

22 Claims, 10 Drawing Sheets

RAIL ANCHOR REMOVER

BACKGROUND OF THE INVENTION

1. Field of the Invention

The invention relates to anchor removers and, more particularly, relates to devices for automatically removing rail anchors from the rails to which they are attached.

2. Description of the Related Art

It is often necessary in the repair or replacement of rails to remove anchors from the base of the rail. This has traditionally been done manually using a sledge hammer to drive the anchor off the rail. Such manual removal usually requires the employment of "anchor removing gangs" of up to ten or more people whose only responsibility is to move along the rails removing the anchors. Removing anchors in this manner is time-consuming, relatively expensive, and may also be potentially dangerous because anchors are typically clipped onto the rails under considerable spring forces which, when released upon the removal of the anchor, may cause the anchor to fly away from the rail and strike and injure people in the vicinity of the rail.

Attempts have been made to automatically remove anchors from rails using an anchor removing machine mounted on a vehicle chassis movable along the rails. One such machine is described in U.S. Pat. No. 5,074,219 to Theurer et al. (the Theurer patent). The machine disclosed in the Theurer patent utilizes a workhead on which are mounted two stripping elements which engage the anchors and which detach the anchors from the rail. Three embodiments are disclosed, the first of which employs a pivotable stripping element which engages the head or gauge side of the anchor and which pulls the anchor towards the inside of the rail, and the second and third of which employ stripping elements which engage the tail or field side end of the anchor and push the anchor towards the inside of the rail.

The devices disclosed in the Theurer patent suffer from several drawbacks and disadvantages. For instance, the stripping elements of the first embodiment may not be capable of removing certain types of anchors without modification. That is, some anchor heads are so flat and extend so far towards the web of the rail that their access by the stripping elements would be blocked by the head or web of the rail unless the stripping elements were specially designed to engage such anchors without interference from the head of the rail. Such a specially designed stripping element may not be suitable for engaging other types of anchors. Actuation of the stripping elements of the first embodiment also requires a relatively complex, two-stroke process in which the elements are pivoted in a first direction so as to be positioned against the head of the rail, and then pivoted in the opposite direction to remove the anchor.

These problems could possibly be alleviated by employing machines constructed in accordance with the second or third embodiments which engage the tail rather than the head side of the anchor. However, such machines may be incapable of driving the anchors all the way off the rail or of windrowing the detached anchors between the rails for future pick up. The need has therefore arisen to assuredly detach different types of anchors from a rail while at the same time permitting the windrowing of such anchors for subsequent pick up.

Another problem associated with the device disclosed in the Theurer patent is that it is difficult to align with the anchors. That is, the workheads must be vertically aligned with the anchors by drives so that the stripping elements may contact and remove the anchors. However, no stops or other devices are provided to assure such alignment. Operation of the drives must accordingly be strictly monitored in an attempt to assure such alignment. Even such close monitoring provides no guarantee of alignment.

OBJECTS AND SUMMARY OF THE INVENTION

It is therefore an object of the invention to provide an anchor remover which can assuredly detach virtually any type of anchor from a rail while at the same time permitting the windrowing of anchors between rails.

It is another object of the invention to provide an anchor remover which is relatively compact and simple in construction but which performs the functions discussed above.

In accordance with a first aspect of the invention, these objects are achieved by providing an anchor removing machine comprising a frame, a ram assembly which is mounted on the frame and which drives the tail of the anchor beneath the base of the rail, a kicker assembly which is mounted on the frame and which drives the tail transversely under the rail towards the gauge side of the rail, and a windrow assembly which is mounted on the frame and which drives the anchor transversely away from the gauge side of the rail.

The ram assembly preferably includes a guide sleeve, a metal bar slidably received in the guide sleeve, and a cylinder. The metal bar has an upper end connected to the cylinder and a lower end which is extendible from the sleeve and which engages the tail of the anchor upon extension of the cylinder.

The kicker assembly may comprise a pivot link having a first end pivotally connected to the frame and having a second end, a cylinder, and a kicker arm having a first end portion pivotally connected to the cylinder, an opposed second end portion for engaging the anchor, and a medial portion pivotally connected to the second end of the pivot link. The second end of the kicker arm moves towards the rail upon extension of the cylinder. Alternatively, the pivot link could be eliminated and the kicker arm connected directly to the metal bar of the ram assembly so as to be raised with the bar when in its inoperable position.

The windrow assembly preferably comprises a pivot link having a first end pivotally connected to the frame and having a second end, a cylinder, and a windrow tool having a first end portion pivotally connected to the cylinder, an opposed second end portion for engaging the anchor, and a medial portion pivotally connected to the second end of the pivot link, the second end of the windrow tool moving away from the rail upon extension of the cylinder.

The ram assembly, kicker assembly, and windrow assembly are preferably automatically and sequentially actuated following actuation of a boxing assembly of the machine. To this end the ram assembly, kicker assembly, and windrow assembly preferably include first, second, and third hydraulic cylinders, respectively. A hydraulic circuit actuates each of the first, second, and third cylinders and includes a pressurized fluid source. First, second, and third valves are located in the hydraulic circuit between the pressurized fluid source and the first, second, and third cylinders. Devices are provided for detecting a fully extended state of at least the first and second cylinders. Devices are also provided for actuating the second and third valves such that the second cylinder is extended only when the means for detecting detects that the first cylinder is fully extended and such that the third cylinder is extended only when the means for detecting detects that the second cylinder is fully extended.

Still another object of the invention is to provide an anchor remover which can be assuredly aligned with anchors prior to removal.

In accordance with another aspect of the invention, this object is achieved by providing an anchor removing machine which comprises a workhead, means for lowering the workhead onto the rail, first and second anchor removing assemblies each of which mounted on the workhead so as to be movable longitudinally with respect to the rail, and at least one of 1) means for automatically centering the workhead with respect to a longitudinal centerline of the rail upon the lowering of the workhead, and 2) means for automatically aligning the first and second anchoring removing assemblies with the first and second anchors by moving the first and second anchor removing assemblies longitudinally with respect to the rail.

Preferably, the means for automatically centering comprises at least one plate mounted on the workhead proximate one side of the rail, and the means for automatically aligning comprises first and second stops for engaging the first and second anchors, each of the stops being mounted on the carriage of one of the anchor removing assemblies, and a boxing cylinder which drives the first and second anchor removing assemblies towards one another such that the first and second stops engage the first and second anchors.

Yet another object of the invention is to provide a method of automatically removing anchors from rails and of windrowing the anchors for subsequent pick up.

In accordance with still another aspect of the invention, this object is achieved by actuating a ram assembly, mounted on a frame of an anchor removing machine, to drive the tail of an anchor beneath a base of a rail, actuating a kicker assembly, mounted on the frame, to drive the tail transversely under the rail towards a gauge side of the rail, and actuating a windrow assembly, mounted on the frame, to drive the anchor transversely away from the gauge side of the rail.

Preferably, the method also includes automatically centering the workhead with respect to a longitudinal centerline of the rail upon the lowering of the workhead onto the rail, and automatically aligning the first and second anchor removing assemblies with the first and second anchors by moving the first and second anchor removing assemblies longitudinally with respect to the rail.

Other objects, features, and advantages of the invention will become apparent to those skilled in the art from the following detailed description and the accompanying drawings. It should be understood, however, that the detailed description and specific examples, while indicating preferred embodiments of the present invention, are given by way of illustration and not of limitation. Many changes and modifications within the scope of the present invention may be made without departing from the spirit thereof, and the invention includes all such modifications.

BRIEF DESCRIPTION OF THE DRAWINGS

Preferred exemplary embodiments of the invention are illustrated in the accompanying drawings in which like reference numerals represent like parts throughout, and in which.

DETAILED DESCRIPTION OF THE PREFERRED EMBODIMENTS

1. Resume

Figure 1:
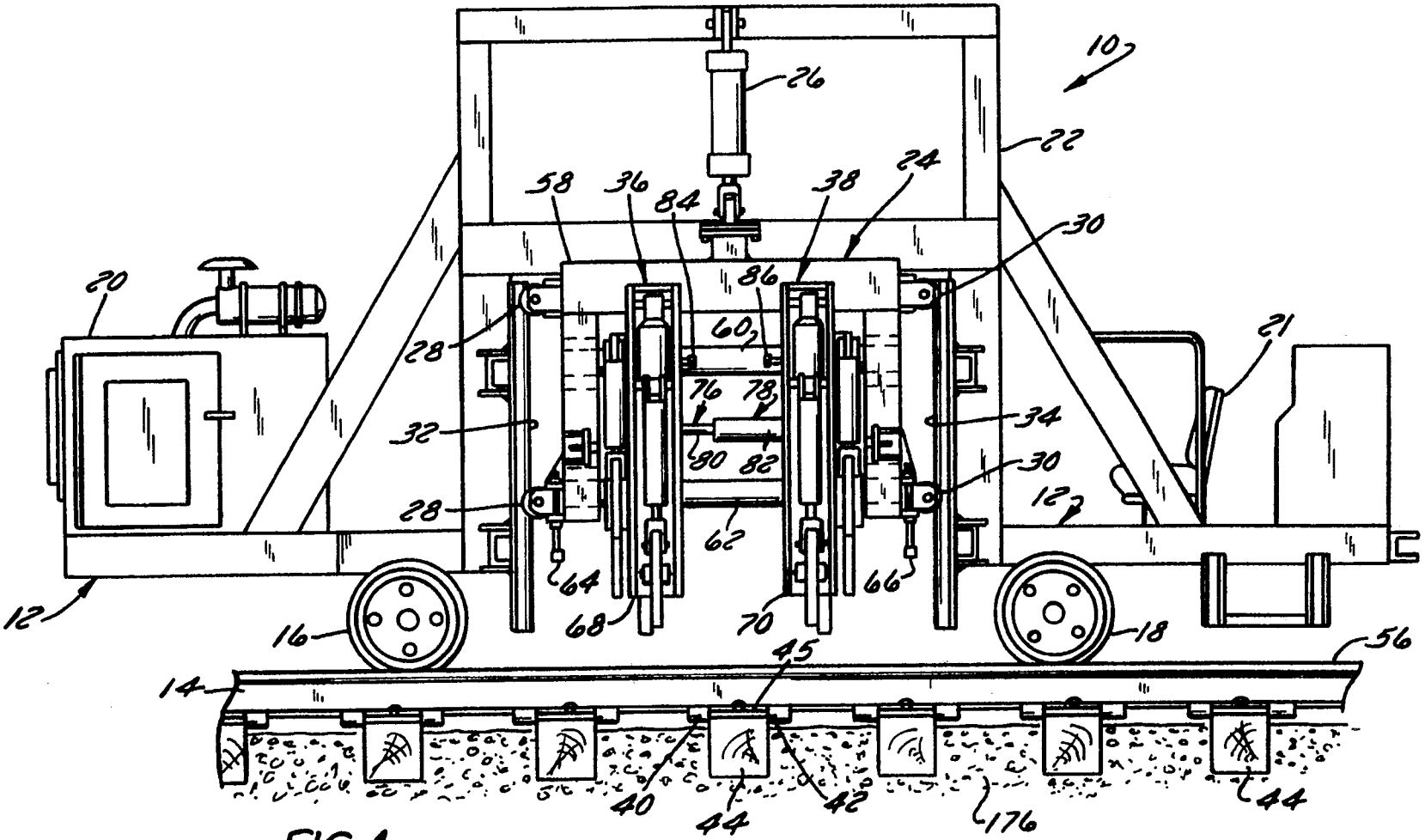
FIG. 1 is a side elevation view of an anchor removing machine constructed in accordance with a preferred embodiment of the invention and illustrating a workhead of the machine in a raised and unboxed position.

Pursuant to the invention, an anchor removing machine is capable of automatically removing anchors from a rail and of windrowing the removed anchors between rails. The machine preferably employs a ram assembly to detach the tail of the anchor from the rail, a field side kicker assembly to drive the anchor towards the gauge side of the rail in order to facilitate anchor removal, and a windrow assembly to engage the head of the anchor and to pull the anchor away from the gauge side of the rail for subsequent pick up. Lateral and vertical alignment between the anchor removing machine and the anchor is assured by opposed plates and by stops, respectively. Preferably, pressure switches or the like prevent the operation of each component of the system until operation of the preceding component is completed.

2. System Overview

Referring now to FIGS. 1–4, an anchor removing machine 10 constructed in accordance with the present invention includes a self-propelled chassis 12 which is movably supported on rails 14 (only one of which is shown) by front and rear wheels 16, 18 and which is driven by hydraulic motors (not shown), which are in turn driven by an engine 20. Operation of the entire machine 10, including the anchor removing assemblies detailed below, is controlled by a single operator seated upon a seat 21.

The chassis 12 presents a frame 22 having a workhead 24 suspended therefrom by a hydraulic lift cylinder 26. Although only a single workhead 24 is illustrated, it should be appreciated that another workhead may, if desired, be located on the opposed side of the chassis 12 and may be adapted to remove the anchors from the opposite rail. Vertical movement of the workhead 24 with respect to the frame 22 is guided by front and rear guide rollers 28, 30 engaging respective guide rails 32, 34 mounted on the frame 22. Mounted on the workhead 24 are opposed anchor removing assemblies 36 and 38 each of which is adapted to remove an anchor 40, 42 located on a respective side of a tie 44.

The anchors 40, 42 to be removed may be any conventional anchors usable with wooden ties. One typical anchor, illustrated in detail in FIGS. 3 and 4, includes a head 46 engaging the base 48 of the gauge side of the rail 14, a body 50 extending transversely beneath the rail 14 adjacent the tie 44, and a tail 52 having an inside surface abutting the edge of the base 48 of the field side of the rail 14. The head 46 of the anchor 40, 42 typically extends towards the web 54 of the rail 14 and may actually extend at or inwardly of a plane containing the outer transverse edge of the head 56 of the rail 14. Conventional tie plates 45 are also mounted on the tie 44 between the anchors 40, 42.

3. Construction of Workhead and Boxing Assembly

Referring now to FIGS. 1, 2, 5, and 6, the workhead 24 comprises a frame 58 on which is supported the workhead guide rollers 28, 30 and which supports guide rods 60, 62 for the anchor removing assemblies. Adjustable stops 64, 66 are threaded into and extend downwardly from the frame 58 for supporting the workhead 24 on the head 56 of the rail 14 at a position amenable to anchor detachment by the anchor removing assemblies 36, 38. The working components of the anchor removing assemblies 36, 38 are mounted on frames provided in the preferred embodiment in the form of movable carriages 68, 70. The carriages 68, 70 are supported on the guide rods 60, 62 by cylindrical sleeves 72, 74 (FIG. 5) permitting movement of the anchor removing assemblies 36, 38 relative to the guide rods 60, 62.

A boxing assembly 76 connects the carriages 68, 70 to one another and is designed to drive selectively the anchor removing assemblies 36, 38 towards and away from one another to permit anchor removal while at the same time facilitating alignment with the anchors 40, 42. The boxing assembly 76 preferably includes a double-acting hydraulic boxing cylinder 78 having a rod portion 80 connected to the carriage 68 of one of the anchor removing assemblies and a cylinder portion 82 connected to the carriage 70 of the other of the anchor removing assemblies. Adjustable stop bolts 84, 86 extend inwardly from the carriages 68, 70 of the anchor removing assemblies 36, 38 to limit movement of the anchor removing assemblies towards one another during the boxing operation in the absence of one of the anchors.

4. Construction of Anchor Removing Assembly

Each of the anchor removing assemblies 36, 38 is identical in construction and is designed to remove a respective one of the anchors 40, 42 on an opposed side of the tie 44. To avoid undue repetition, only one such anchor removing assembly 38 will be described.

Referring especially to FIGS. 5–9 anchor removing assembly 38 includes guide plates 88, 90 for aligning the assembly and workhead 24 with respect to the longitudinal centerline of rail 14; a clamp assembly 92 for clamping the anchor removing assembly 38 to the rail 14; a stop 94 for vertically aligning the anchor removing assembly 38 with the anchor 42; and ram, field side kicker, and windrow assemblies 96, 98 and 100 for detaching the tail 52 of the anchor 42 from the rail 14, for positioning the head 46 of the anchor 42 for anchor removal, and for removing and windrowing the anchor 42, respectively. Each of these devices will now be described in turn.

The guide plates 88, 90 and clamp assembly 92 cooperate to assure that the anchor removing assembly 38 is positioned vertically above the longitudinal centerline of the rail 14 and to securely clamp the anchor removing assembly 38 to the rail 14. Accurate alignment of the anchor removing assembly 38 above the tie 44 is important to prevent components of the anchor removing assembly 38 from striking the top of the tie 44 and damaging the workhead 24 while still assuring proper operation of the anchor removing assembly 38. To this end, the guide plates 88, 90 are bolted or otherwise secured to the carriage 70 and have slightly tapered inner faces adapted to engage the transverse edges of the head 56 of the rail 14. The gauge side guide plate 90 also serves as a stop which opposes the clamping forces imposed by the clamp assembly 92 and facilitates clamping. The field side plate 88 is not essential for alignment and could be omitted if desired.

Figure 6:
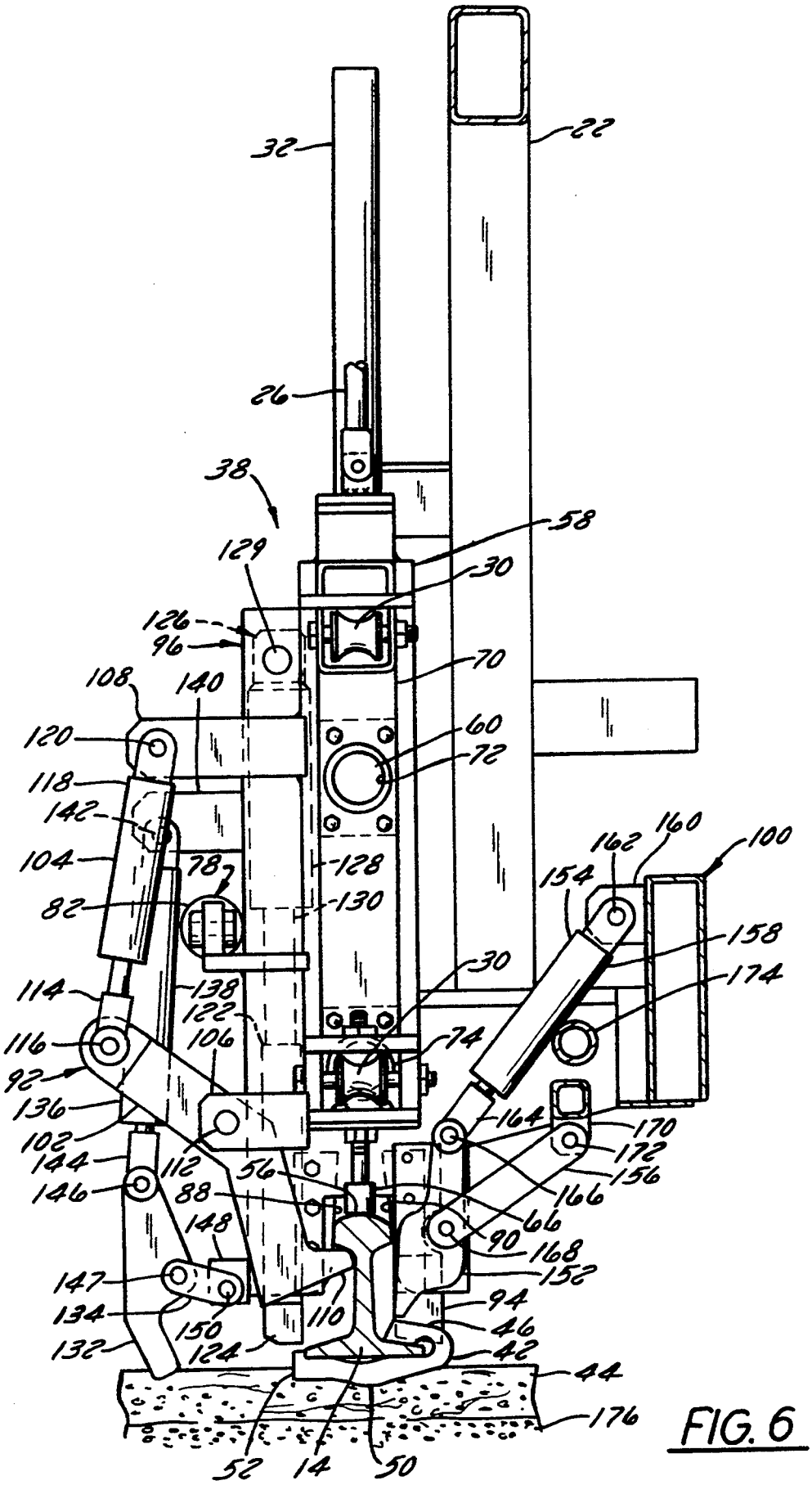
FIG. 6 corresponds to FIG. 5 but illustrates the workhead in a lowered and clamped position.
Figure 7:
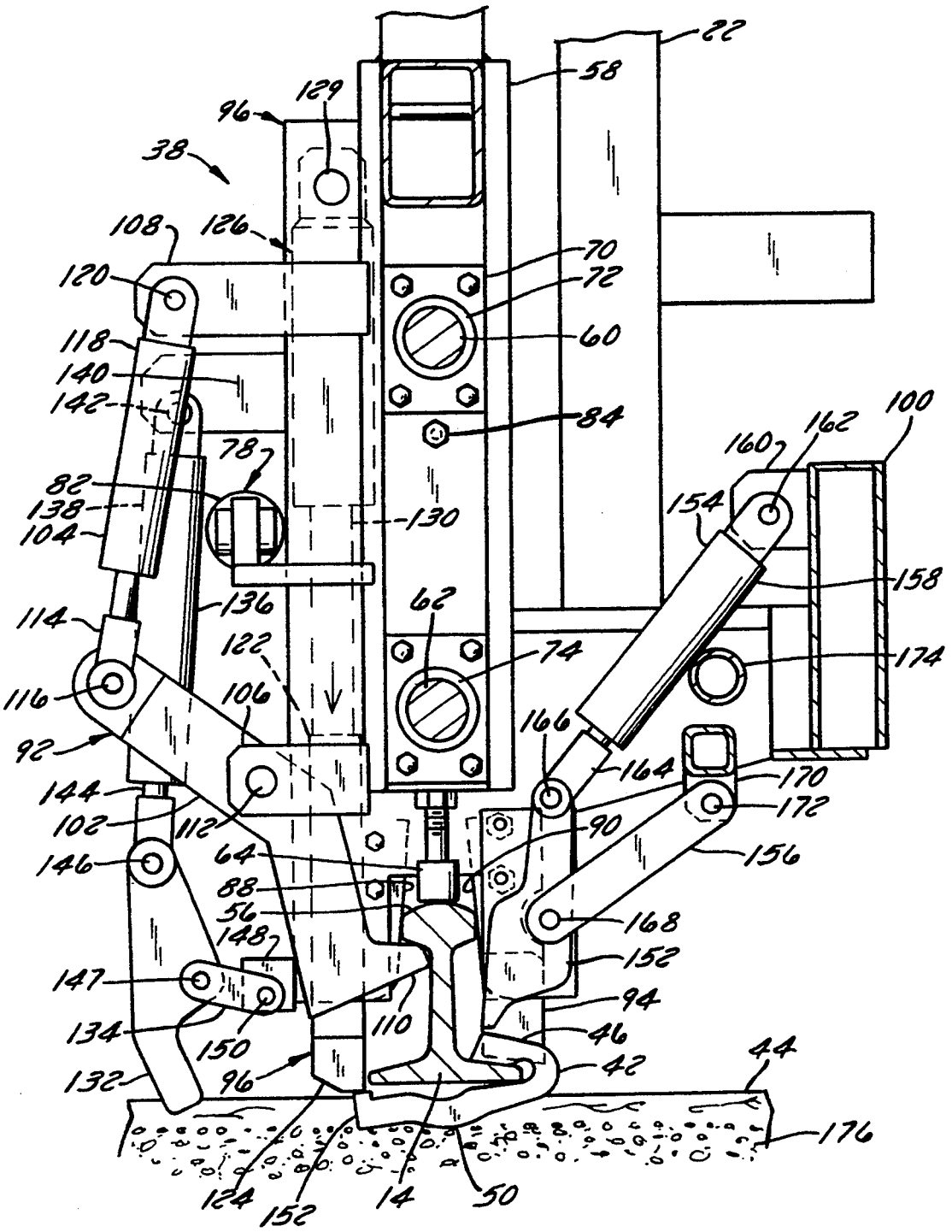
FIG. 7 is a sectional end elevation view of a portion of the anchor removing machine of FIGS. 1 and 2 taken along the lines 7—7 in FIG. 2 and illustrating the operation of a ram assembly of the machine.
Figure 8:
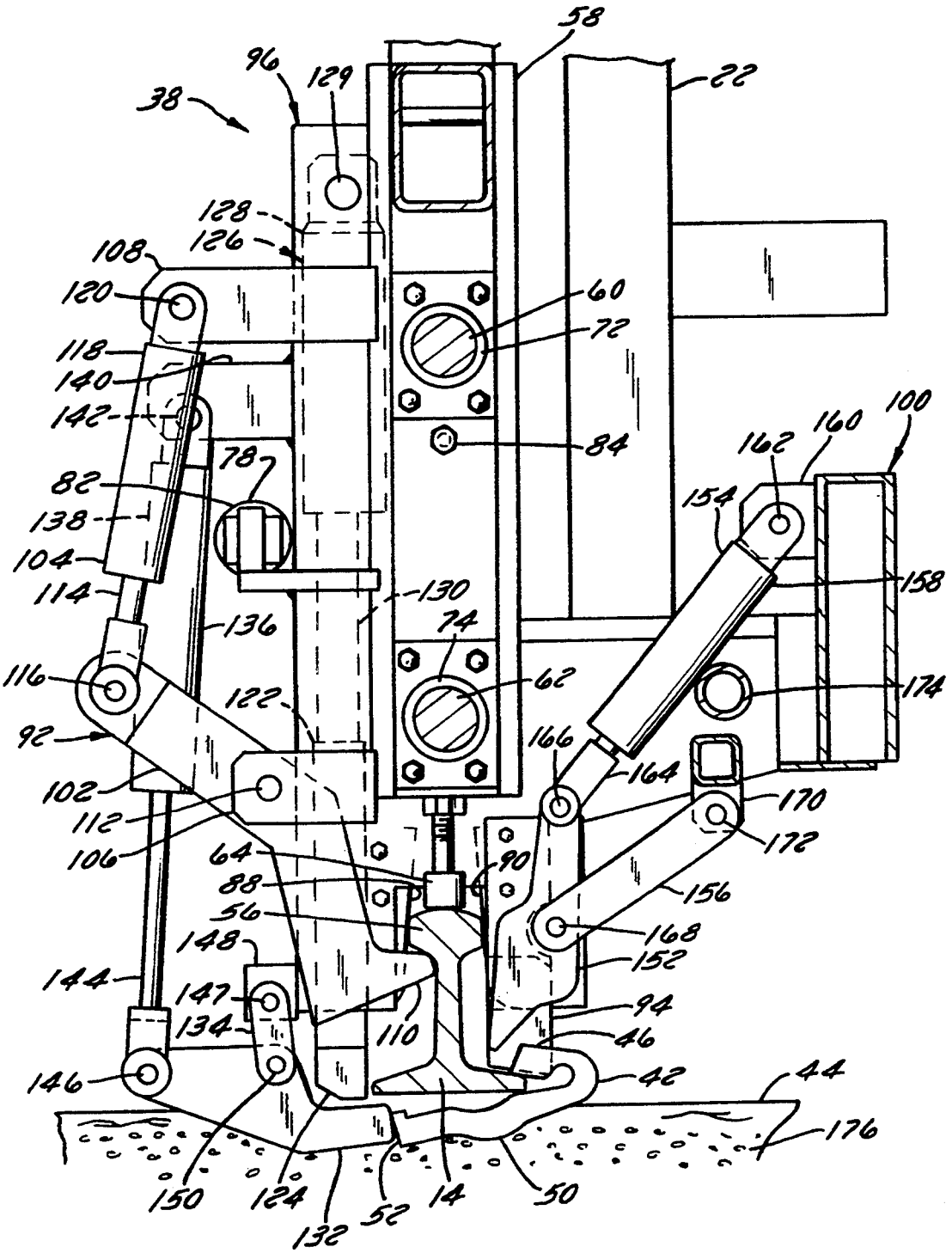
FIG. 8 corresponds to FIG. 7 but illustrates the operation of a field side kicker assembly of the machine.
Figure 9:
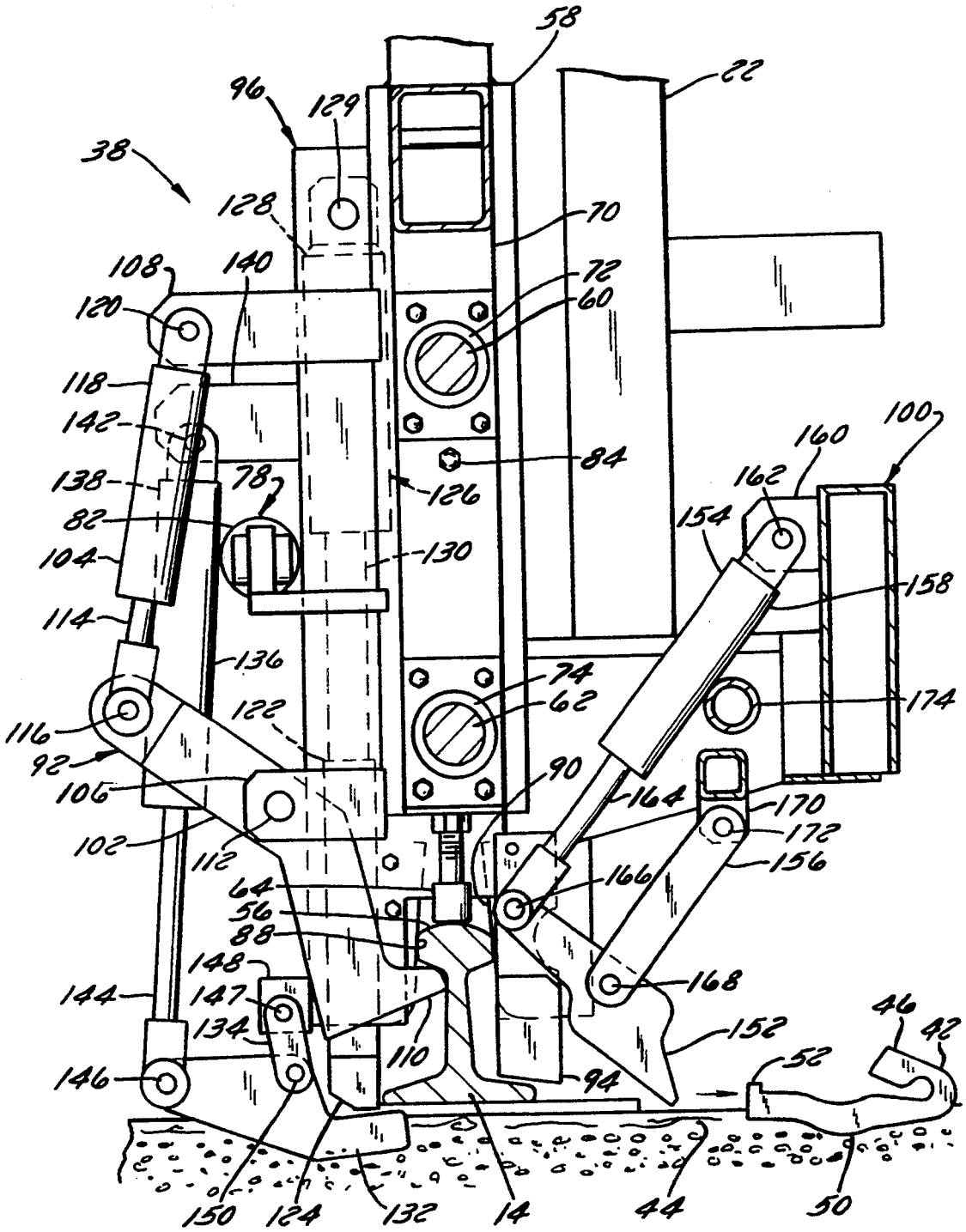
FIG. 9 corresponds to FIGS. 7 and 8 but illustrates the operation of a windrow assembly of the machine.

The clamp assembly 92 includes a clamping tool 102 and a double-acting hydraulic clamp cylinder 104 pivotally mounted to respective brackets 106, 108 which are in turn welded or otherwise affixed to the carriage 70. The clamping tool 102 has a clamp face 110 located in its lower end portion, receives a pivot pin 112 in a medial portion thereof for connection to bracket 106, and is connected to a rod portion 114 of the hydraulic cylinder 104 at its upper end portion via a pivot pin 116. A cylinder portion 118 of the clamp cylinder 104 is pivotally connected at its upper end to the bracket 108 by a pivot pin 120. As illustrated in FIG. 6, the clamping tool 102 pivots upon the extension of the rod portion 114 of cylinder 104 such that the clamp face 110 engages the rail 14 at the juncture between the head 56 and the web 54 so as to clamp the rail 14 between the gauge side guide plate 90 and the clamping tool 102.

Stop 94 is designed to engage the outer lateral edge of the anchor 42 upon the retraction of the boxing cylinder 78 to ensure vertical alignment of the anchor removing assembly 38 with the longitudinal centerline of the anchor 42. The preferred stop 94 comprises a simple plate which is welded or otherwise affixed to the carriage 70 and which, when the assembly 38 is lowered and "boxed" as illustrated in FIG. 6, is positioned proximate the base 48 of the rail 14 and contacts the lateral side of the head 46 of the anchor 42 to prevent further movement of the anchor removing assembly 38 towards the tie 44.

The ram assembly 96 is designed to drive the tail 52 of the anchor 42 beneath the base 48 of the rail 14, thereby releasing the anchor 42 from the rail 14. To this end, ram assembly 96 preferably includes a vertical guide sleeve 122 welded or otherwise affixed to the carriage 70, a metal bar 124 slidably positioned within the sleeve 122 and protruding from the bottom of the sleeve towards the tail 52 of the anchor 42, and a double-acting hydraulic ram cylinder 126. Cylinder 126 has a cylinder portion 128 connected at its upper end to the carriage 70 by a pin 129 and a rod portion 130 extending downwardly from the cylinder portion 128 and connected at its lower end to the metal bar 124.

Field side kicker assembly 98 is adapted to drive the anchor 42 towards the gauge side of the rail 14 after the anchor 42 has been released from the rail 14 by the ram assembly 96. Kicker assembly 98 preferably includes a kicker arm 132, a pivot link 134, and a double-acting hydraulic kicker cylinder 136. Kicker cylinder 136 has a cylinder portion 138 pivotally connected at its upper end to a bracket 140 by a first pivot pin 142 and a rod portion 144 extending from the cylinder portion 138 and pivotally connected at its lower end to a first end portion of the kicker arm 132 by a second pivot pin 146. The kicker arm 132 has a medial portion which is pivotally connected to a first end of the pivot link 134 by a pivot pin 147, and a second end portion which is adapted to engage the tail 52 of the anchor 42 so as to drive the anchor under the rail 14. The second end of the pivot link 134 is pivotally connected to another bracket 148 by a pivot pin 150. Pivot link 134 cooperates with the kicker arm 132 and the cylinder 136 to optimize the stroke of the second end of kicker arm 132 for driving the anchor 42 in the desired manner.

The windrow assembly 100 is designed to pull the anchor 42 inwardly away from the rail 14 and to position the anchor 42 between the rails 14 for subsequent pick up. To this end, windrow assembly 100 preferably includes a windrow tool 152, a double-acting hydraulic windrow cylinder 154 for actuating the windrow tool 152, and a pivot link 156 for controlling the motion of the tool 152. The cylinder 154 includes a cylinder portion 158 pivotally connected at its upper end to a bracket 160 by a pivot pin 162, and a rod portion 164 protruding from the cylinder portion 158. The windrow tool 152 has a first end portion pivotally connected to the rod portion 164 of cylinder 154 by a pivot pin 166, a second end portion adapted to engage the head 46 of the anchor 42, and a medial portion pivotally connected to a first end of the pivot link 156 by a pivot pin 168. The second end of the pivot link 156 is pivotally connected to a bracket 170 of carriage 70 by a pivot pin 172. Pivot link 156 cooperates with the windrow tool 152 and the cylinder 154 to optimize the stroke of the second end of the windrow tool 152 for removing and windrowing the anchor 42. A support tube 174 is mounted on the carriage 70 and engages the cylinder portion 158 of cylinder 154 so as to prevent twisting of the windrow assembly 100 during operation. If desired, guide plates (not shown) may be attached to the workhead on opposite sides of the windrow tool 152 so as to prevent the anchor from tipping over after it has been detached from the rail 14 by the ram and kicker assemblies 96 and 98 and to thereby assure access to the anchor head 46 by the windrow assembly 100.

5. Construction of Hydraulic Circuit

Figure 10:
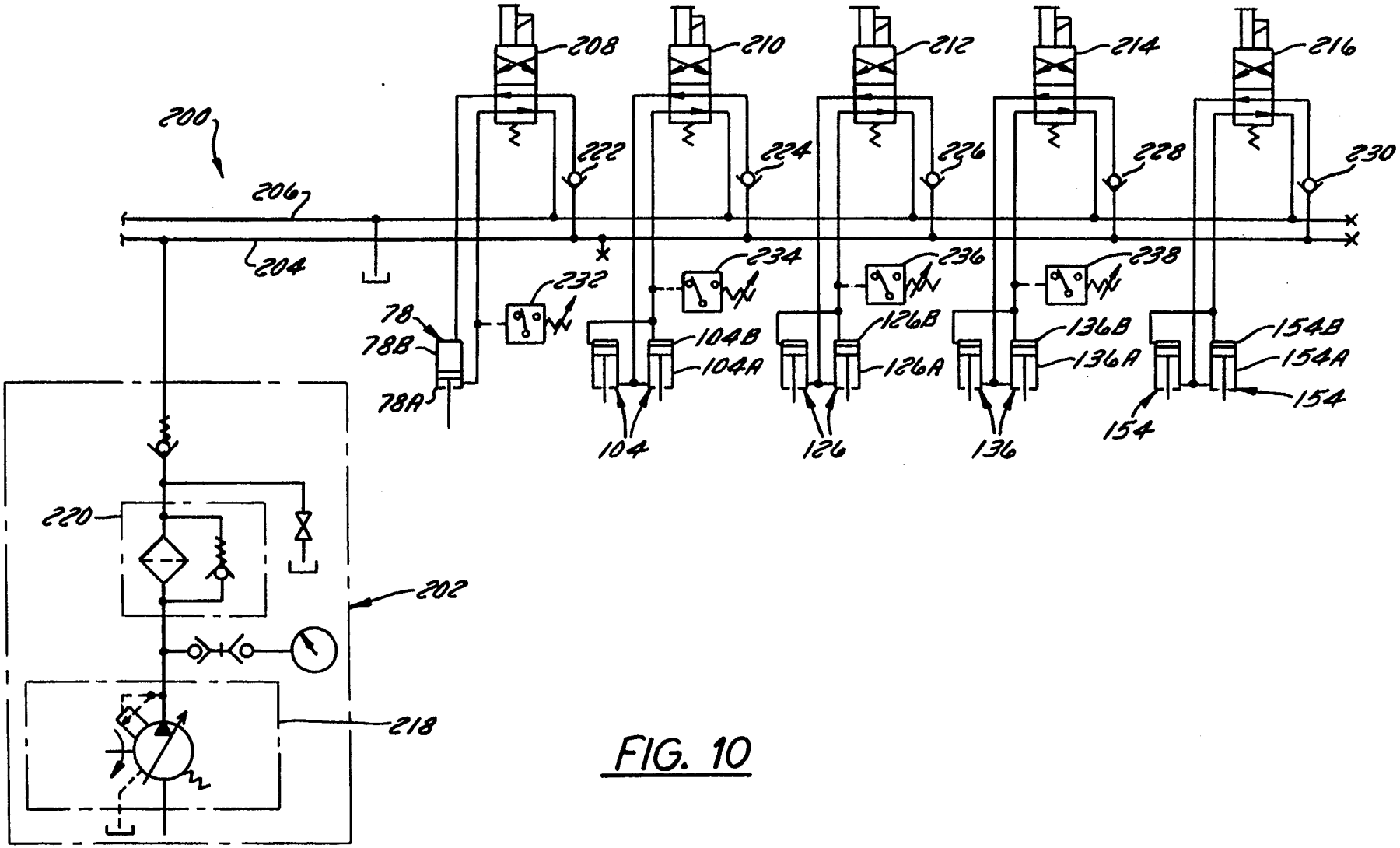
FIG. 10 illustrates a portion of a hydraulic circuit and accompanying pressure switches used to actuate the anchor removing machine of FIGS. 1–9.

The hydraulic cylinders for performing the anchor removing operation could all be operated individually, e.g., by the manual operation of levers or switches. It is preferred, however, that these cylinders be sequentially and automatically operated upon the actuation of a single lever or switch. A variety of control systems could be used to provide such a sequential operation. A particularly simple and preferred configuration is illustrated in FIG. 10 and includes a hydraulic circuit 200 in which is disposed means for controlling the supply and exhaust of pressurized hydraulic fluid to and from the various cylinders. Circuit 200 includes a conventional pressure source 202, a common supply line 204, and a common vent or exhaust line 206. The boxing, clamp, ram, kicker, and windrow cylinders 78, 104, 126, 136, and 154 are selectively connected to the supply and exhaust lines 204 and 206 by respective solenoid valves 208, 210, 212, 214, and 216. Pressure source 202 is conventional and includes a pump assembly 218 and a suitable filtration system 220. Other portions of the circuit 200, not shown, are conventional and control positioning of the chassis 12 and raising and lowering of the workhead 24. A discussion of these portions is omitted for the sake of brevity.

Each of the valves 208, 210, 212, 214, and 216 preferably comprises a four-way valve which in its deenergized position places the associated assembly in a deactuated position and in its energized position places the associated assembly in an actuated position. Although most valves are two position valves, some, if desired, could be three position valves. For instance, the valve 210 could, in addition to assuming energized and deenergized positions, assume a neutral (pressure holding) position during operation of the ram, kicker, and windrow assemblies so as not to apply a positive boxing force during the anchor removal operation.

Since the boxing cylinder 78 is retracted in its actuated position, the associated valve 208 connects the piston side 78A of the boxing cylinder 78 to the supply line 204 and the cylinder side 78B to the exhaust line 206 in its energized state and otherwise connects the cylinder side 78B to the supply line 204 and the piston side 78A to the exhaust line 206 as illustrated. The remaining cylinders 104, 126, 136, and 154 are extended in their actuated positions. The remaining valves 210, 212, 214, and 216 therefore connect the cylinder side 104B, 126B, 136B, and 154B of the respective cylinder or cylinders 104, 126, 136, and 154 to the common supply line 204 and the piston side 104A, 126A, 136A, and 154A to the exhaust line 206 in their energized positions and otherwise connect the cylinder sides to the exhaust line 206 and the piston side to the supply line 204 as illustrated. Reverse fluid flow from the supply ports of the valves 208, 210, 212, 214, and 216 to the supply line 204 is prevented in each case by a respective check valve 222, 224, 226, 228, and 230.

The circuit 200 is preferably controlled such that the solenoid valve 208 for the boxing cylinder 78 is energized by the manual actuation of a lever or switch, and the remaining valves 210, 212, 214, and 216 are sequentially and automatically energized upon full extension of the preceding cylinder. The term "full extension" as used herein with respect to the operation of a hydraulic cylinder does not necessarily mean that the piston has been extended from the cylinder by its maximum possible amount. Rather, this term means that further movement of the piston in the direction resulting in actuation of the associated device is prevented either by maximum piston stroke into or out of the cylinder or by engagement of the device operated by the piston with some element inhibiting further piston or cylinder movement.

Many devices could be used to provide the desired sequential and automatic operation of the cylinders 78, 104, 126, 136, and 154. For instance an ECU could receive signals from pressure sensors or the like and trigger sequential operation of the valves using suitable control logic. A more simplified construction is preferred, however, in which the detectors comprise pressure switches 232, 234, 236, and 238 which are closed when the pressure increases in the respective cylinders 78, 104, 126, and 136 upon full cylinder extension as defined above, thereby completing a circuit supplying power from a suitable power source (not shown) to the associated solenoid valve. The manner in which such pressure switches operate is, per se, well known and will not be described in further detail.

6. Operation of Anchor Removing Machine

Figure 2:
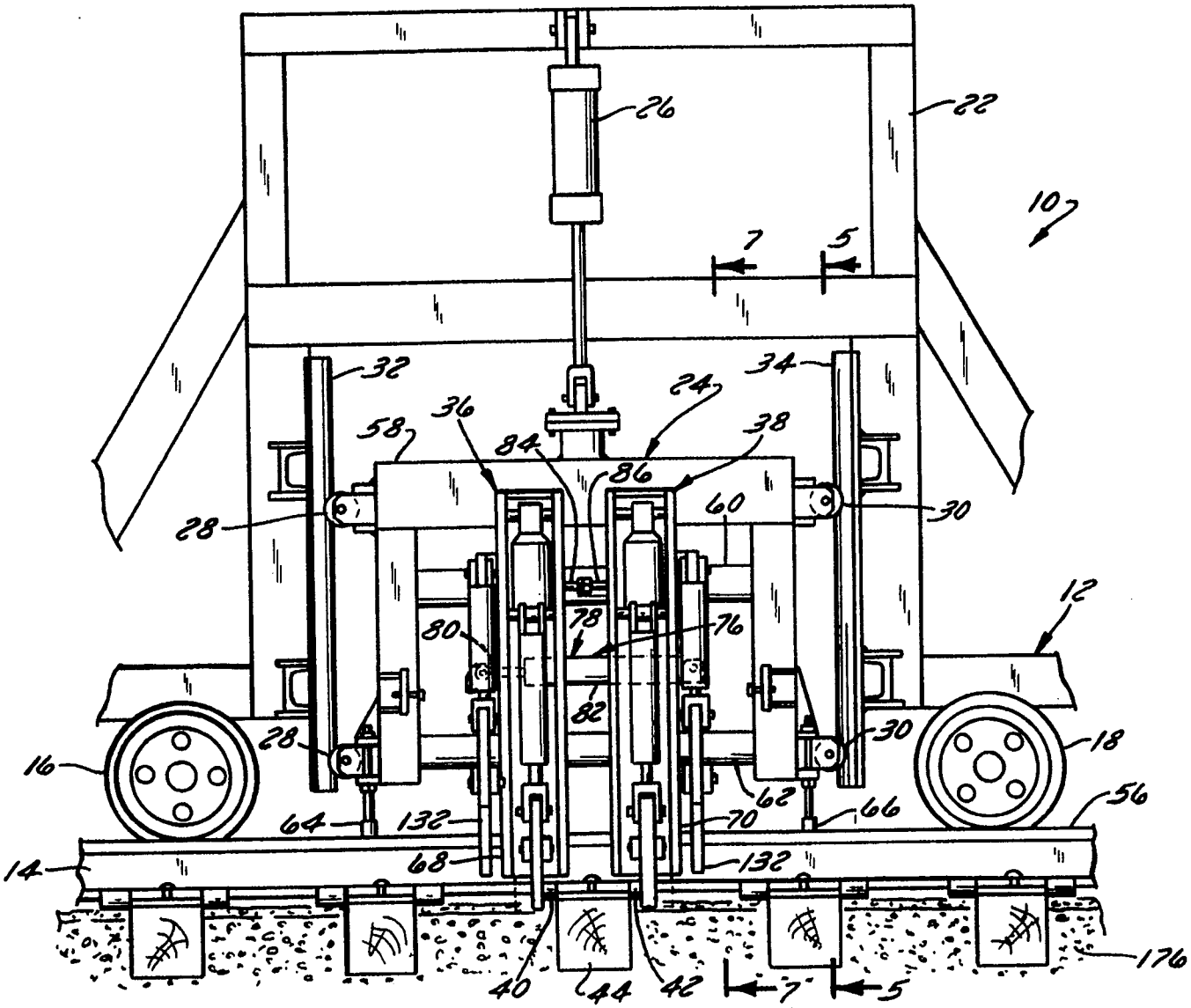
FIG. 2 is a side elevation view of a portion of the machine of FIG. 1 illustrating the workhead in a lowered and boxed position.
Figure 3:
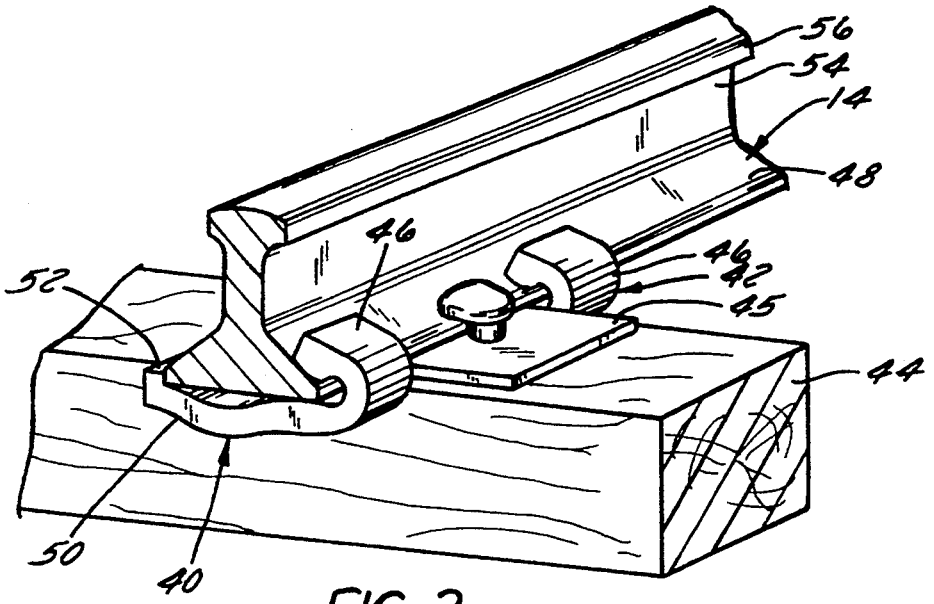
FIG. 3 is a perspective view of a portion of a rail to which is applied anchors which may be removed by the present invention.
Figure 4:
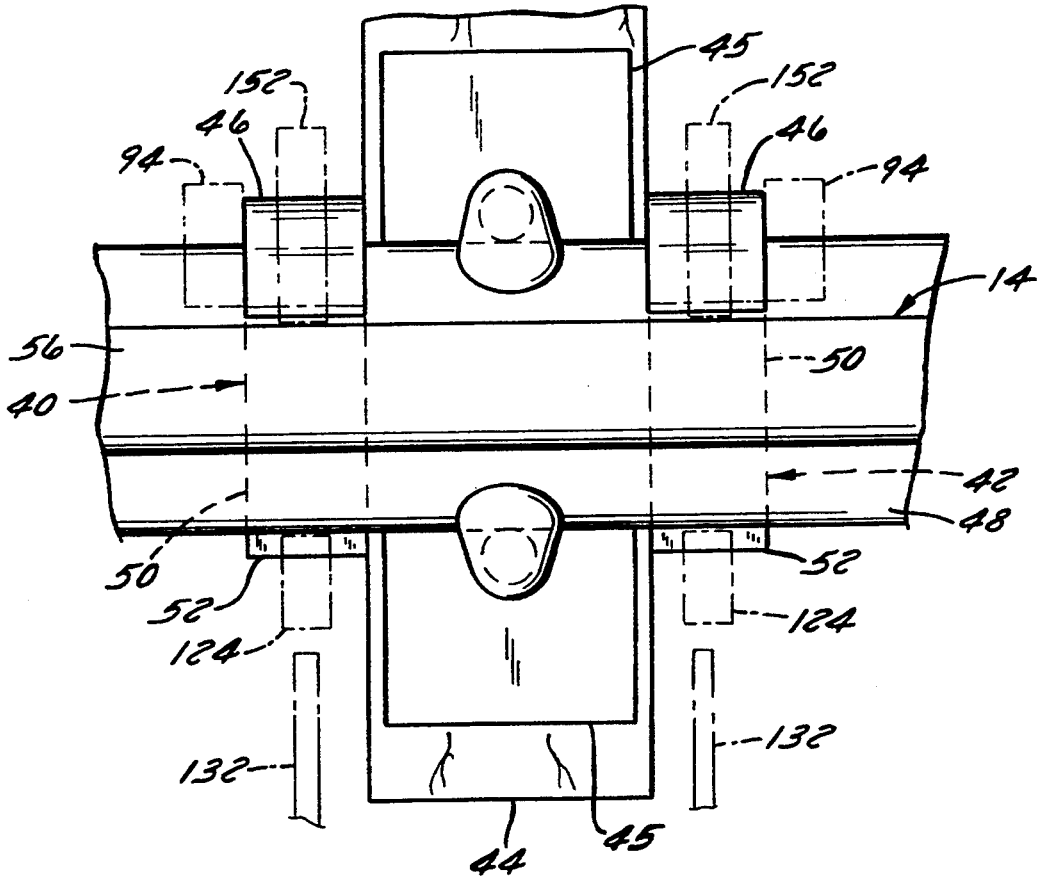
FIG. 4 is a plan view of FIG. 3 which also illustrates in phantom lines components of the anchor removing machine.
Figure 5:
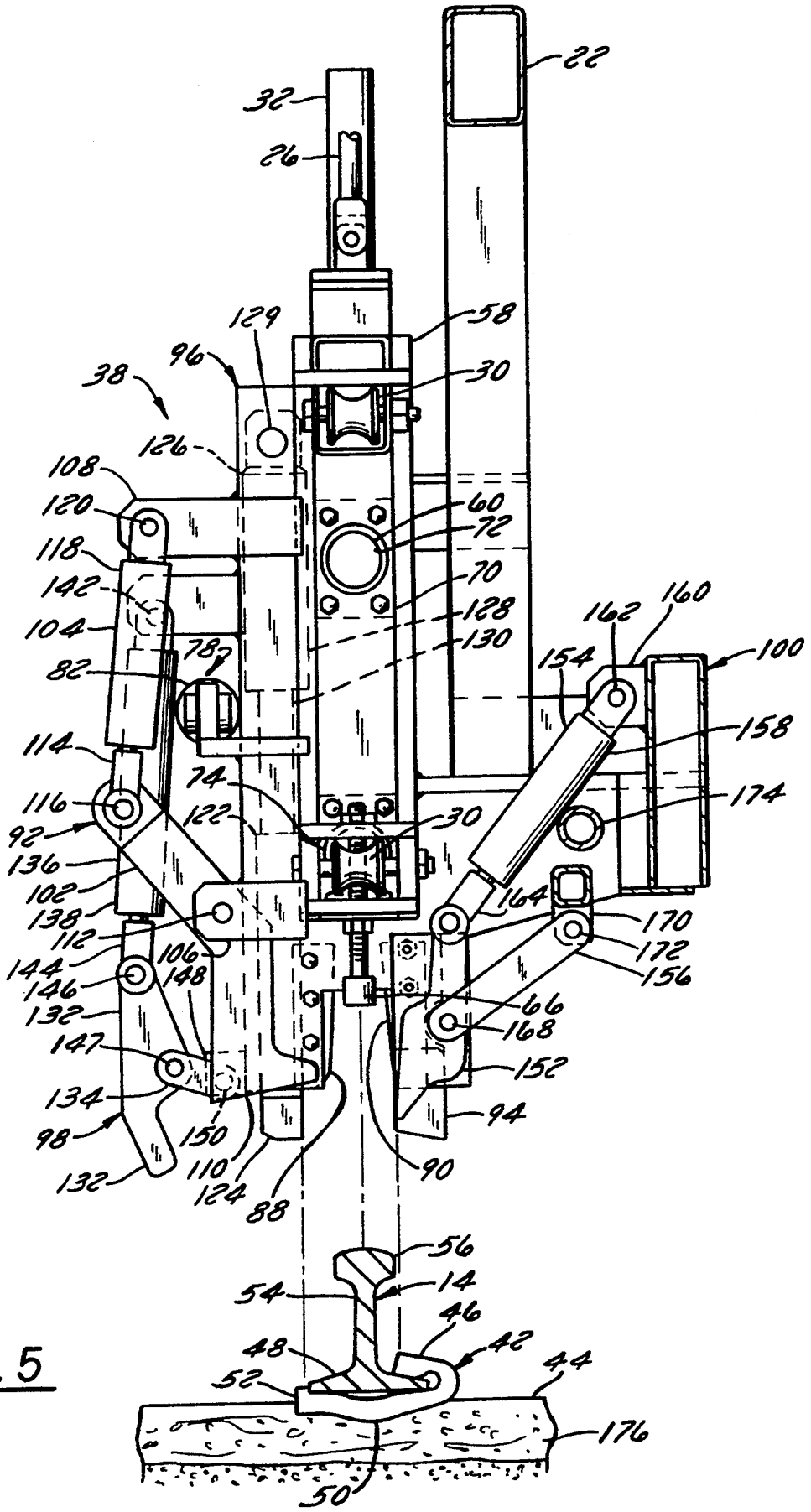
FIG. 5 is a sectional end elevation view of a portion of the anchor remover of FIGS. 1 and 2 taken along the lines 5—5 in FIG. 2 and illustrating the workhead in a raised position.

In operation, the anchor removing process is initiated by positioning the chassis 12 of machine 10 on the rails 14 such that the workhead 24 is approximately centered over a tie 44 flanked by the anchors 40, 42 to be removed as illustrated in FIGS. 1 and 2. The workhead 24 is then lowered by operation of the lift cylinder 26 from the position illustrated in FIGS. 1 and 5 to that illustrated in FIGS. 2 and 6 in which the stops 64, 66 rest on the head 56 of rail 14. In this case, a deflector (not shown) could be provided to block the anchors. Engagement of the guide plates 88, 90 with the head 56 of the rail 14 during workhead lowering assures that the workhead 24 is positioned vertically above the longitudinal centerline of the rail 14. The anchor removing operation then takes place through the following process.

First, a lever or switch or the like is actuated by the operator to energize the solenoid valve 208, thereby resulting in the supply of pressurized fluid to the piston end 78A of boxing cylinder 78 and retracting the boxing cylinder 78. Boxing cylinder retraction drives the anchor removing assemblies 36, 38 towards one another from the position illustrated in FIG. 1 to that illustrated in FIG. 2. The anchor removing assemblies 36, 38 are aligned with the anchors 40, 42 during this movement via contact between the stops 94 and the outer lateral edges of the anchors 40, 42. In the aligned position, the bar 124 of the ram assembly 96 is positioned immediately above the tail 52 of the anchor 42, and the second end of the kicker arm 132 is aligned with the anchor tail. The windrow tool 152 is positioned near the web 54 of the rail 14 and, depending on the construction of the anchor 42, may be positioned either above the head 46 of the anchor 42 as illustrated or between the anchor head and the web of the rail. Should one of the anchors, e.g., 40 be missing, alignment between the other anchor 42 and the other anchor removing assembly 38 is assured by engagement of the other stop 94 with the other anchor 42 and engagement of the adjustable stop bolts 84 and 86 with one another.

When the boxing operation is complete, a resulting pressure increase in the piston end 78A of cylinder 78 triggers the pressure switch 232 resulting in energization of solenoid valve 210 and the supply of pressurized fluid from the supply line 204 to the cylinder ends 104B of the clamp cylinders 104. The rod portion 114 of each clamp cylinder 104 is then extended to pivot the clamping tool 102 to a position illustrated in FIG. 6 in which the clamp face 110 of the clamping tool 102 is securely clamped to the rail 14 against the reaction forces imposed by plate 90.

Full extension of the rod portion 114 of clamp cylinder 104 actuates the pressure switch 234, thereby resulting in actuation of ram assemblies 96. Specifically, solenoid valve 212 is energized to supply pressurized fluid to the cylinder ends 126B of ram cylinders 126, thus causing the ram cylinder piston portions 130 to extend. Extension of the rod portion 130 of each of the ram cylinders 126 results in the lowering of the associated metal bar 124 ram from the position illustrated in FIG. 6 to that illustrated in FIG. 7 in which it engages the tail 52 of the anchor 42 and drives the tail 52 beneath the bottom of the rail 14, thereby releasing the anchor 42 from the rail 14.

It should be noted at this point that the windrow assembly 100 and/or the kicker assembly 98 need not be employed in every instance because release of the tail 52 of the anchor 42 from the rail 14 releases spring forces, imposed on the anchor 42 during attachment to the rail, which may propel the anchor 42 inward away from the rail 14. Accordingly, these assemblies can be disabled via operation of toggle switches or the like (not shown) connected to the controller. In those instances in which the windrow assembly 100 is required for anchor removal, the kicker assembly 98 is useful to drive the head 46 of the anchor 42 away from the web 54 of the rail 14 and to raise it to the position in which it can be accessed by the windrow tool 152. Even if not required for anchor removal, the windrow assembly 100 may still be useful for anchor windrowing. The discussion which follows describes an operation in which neither assembly 98 nor assembly 100 has been disabled.

The pressure increase occurring upon full extension of the ram cylinder 126 triggers the pressure switch 236, resulting in energization of the fourth solenoid valve 214 and the supply of pressurized hydraulic fluid to the cylinder end 136B of the kicker cylinder 136 of each of the kicker assemblies 98. This results in the extension of rod portion 144 and the pivoting of the kicker arm 132 of each assembly 98 from the position illustrated in FIG. 7 to that illustrated in FIG. 8 in which the anchor 42 is driven transversely towards the gauge side of the rail 14. Since some or most of the anchor 42 is typically embedded in ballast 176, this movement tends to result in the pivoting of the head 46 of the anchor 42 upwardly, thereby facilitating engagement of the head 46 by the windrow assembly 100.

Full extension of the rod portion 144 of kicker cylinder 136 triggers the final pressure switch 238 and results in energization of the solenoid valve 216. Pressurized fluid is then supplied to the cylinder end 154B of each of the windrow cylinders 154. The windrow tool 152 is then pivoted by extension of the windrow cylinder rod portion 164 from the position illustrated in FIG. 8 to that illustrated in FIG. 9 in which the anchor 42 is pulled out from under the rail 14 and positioned between the rails in a windrow for subsequent pick up by the windrow tool 152. Only unidirectional travel of the windrow tool is required because the anchor 42 is positioned for contact with the tool 152 by the kicker assembly 98 prior to operation of the windrow assembly 100.

After the anchor removing operation is complete, the workhead 24 is raised in a manner which is, per se, well known. Preferably, raising of the workhead 24 also results in deenergization of the first through fifth solenoid valves 208, 210, 212, 214, and 216, thereby returning the entire workhead 24 and all the components of both of the anchor removing assemblies 36, 38 to their initial positions and preparing the anchor removing machine 10 for its next cycle of operation.

It should be noted that neither the ram assembly 96, kicker assembly 98, nor the windrow assembly 100 need take the form illustrated and described above. A possible alternative construction will now be described.

7. Construction and Operation of Second Embodiment

Figure 11:
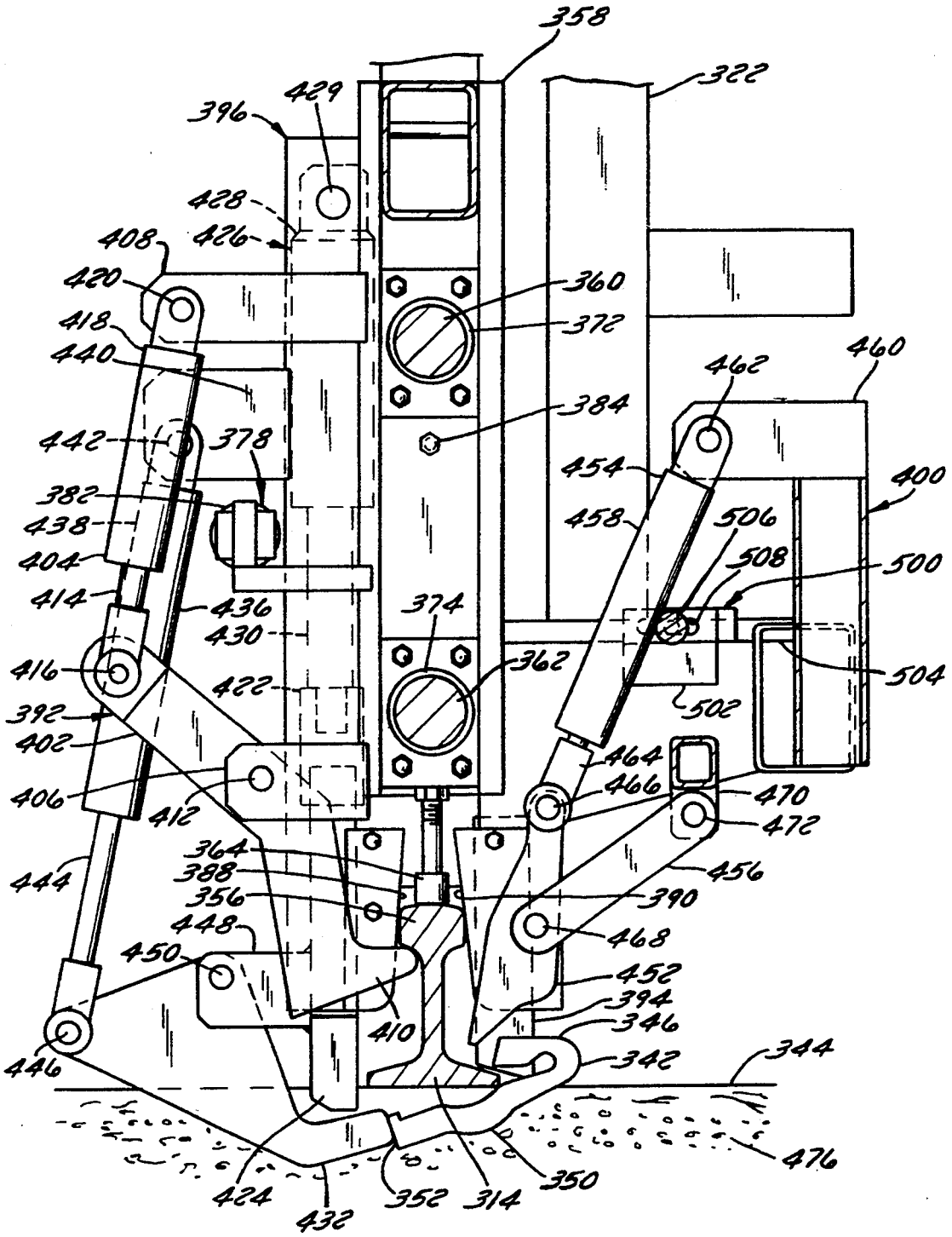
FIG. 11 corresponds to FIG. 8 but illustrates an anchor removing machine constructed in accordance with a second embodiment of the invention.

Referring now to FIG. 11, an anchor removing assembly 38 is illustrated which is usable with the anchor removing machine 10 and which is in most respects identical to the anchor removing assembly 38 described above. Elements of assembly 338 corresponding to those of assembly 38 are accordingly designated by the same reference numerals, incremented by 300. Anchor removing assembly 338 thus includes guide plates 388, 390 for aligning the assembly and workhead with respect to the longitudinal centerline of rail 314; a clamp assembly 392 for clamping the anchor removing assembly 338 to the rail 314; a stop 394 for horizontally aligning the anchor removing assembly 338 with the anchor 342; and ram, field side kicker, and windrow assemblies 396, 398 and 400 for detaching the tail 352 of the anchor 342 from the rail 314, for positioning the head 346 of the anchor 342 for anchor removal, and for removing and windrowing the anchor 342, respectively. Assembly 338 is actuated by the hydraulic circuit detailed in section 5. above. Only the kicker assembly 398 and, to a lesser extent, the windrow assembly 400 differ from the corresponding assemblies of the first embodiment. Only these assemblies will be described, a description of the remainder of assembly 338 being omitted for the sake of brevity.

Field side kicker assembly 398, like the assembly 98 described above, is adapted to drive the anchor 342 towards the gauge side of the rail 314 after the anchor 342 has been released from the rail 314 by the ram assembly 396. Kicker assembly 398 preferably includes a kicker arm 432, a bracket 448, and a double-acting hydraulic kicker cylinder 436. Kicker cylinder 436 has a cylinder portion 438 pivotally connected at its upper end to a bracket 440 by a first pivot pin 442 and a rod portion 444 extending from the cylinder portion 438 and pivotally connected at its lower end to a first end portion of the kicker arm 432 by a second pivot pin 446. The kicker arm 432 has a medial portion which is pivotally connected to a first end of the bracket 448 by a pivot pin 450, and a second end portion which is adapted to engage the tail 352 of the anchor 342 so as to drive the anchor under the rail 314. Bracket 448 is fixed to the metal bar 424 of ram assembly 396 so as to be raiseable and lowerable therewith for reasons detailed below.

The windrow assembly 400, like the windrow assembly 100 described above, is designed to pull the anchor 342 inwardly away from the rail 314 and to position the anchor 342 between the rails 314 for subsequent pick up. To this end, windrow assembly 400 preferably includes a windrow tool 452, a double-acting hydraulic windrow cylinder 454 for actuating the windrow tool 452, and a pivot link 456 for controlling the motion of the tool 452. The cylinder 454 includes a cylinder portion 458 pivotally connected at its upper end to a bracket 460 by a pivot pin 462, and a rod portion 464 protruding from the cylinder portion 458. The windrow tool 452 has a first end portion pivotally connected to the rod portion 464 of cylinder 454 by a pivot pin 466, a second end portion adapted to engage the head 346 of the anchor 342, and a medial portion pivotally connected to a first end of the pivot link 456 by a pivot pin 468. The second end of the pivot link 456 is pivotally connected to a bracket 470 of carriage 370 by a pivot pin 472. Pivot link 456 cooperates with the windrow tool 452 and the cylinder 454 to optimize the stroke of the second end of the windrow tool 452 for removing and windrowing the anchor 342.

Windrow assembly 400 differs from the windrow assembly 100 described above only in that the support tube 174 has been replaced by an adjustable support assembly 500. Assembly 500 includes opposed plates 502 welded or otherwise affixed to longitudinally spaced brace plates 504 of the carriage 370 (only one of which is illustrated), and a support assembly 506 extending through slots 508 in the plates 502 and forming a support for the windrow cylinder 454 so as to 1) prevent twisting of the cylinder 454 during operation and 2) determine the angle of the cylinder 454. Support assembly 506 preferably comprises a rod extending between the plates 504 screw clamps or another suitable device for selectively 1) locking the assembly 506 in position within the slots 508 and 2) permitting the assembly 506 to slide within the slots 508. The position of assembly 506 can be adjusted to adjust the position of the windrow tool 452 as detailed below.

The operation of assembly 338 is identical to the operation of assembly 38 described above with the following exceptions.

First, interference between the windrow tool 452 and the anchor 342 is prevented by adjusting the position of the assembly 506 of support assembly 500 prior to operation. That is, the position of the second end of the windrow tool 452 is determine by the angle of windrow cylinder 454 and, since the windrow cylinder rests on assembly 506, the position of the tool 452 is determined by the position of the assembly 506 within slots 508. The position of the assembly 506 should be adjusted prior to an anchor removing session such that the second end of tool 452 is located in its deactuated position just above the level of the head 346 of anchor 342. Positioning the windrow tool 452 in this manner prevents interference between the tool 452 and the anchor 342 while at the same time assuring adequate contact during operation of the windrow assembly 400.

Second, replacement of the pivot link 134 of the kicker assembly 98 of the first embodiment with the bracket 448 precludes interference between the kicker arm assembly 398 and the ballast 476 upon lowering of the workhead. That is, with the assembly 38 of FIGS. 1–10, the kicker arm 132 is located near the bottom of the assembly 38 and may, depending upon the depth of ballast 176 surrounding the tie 44, be forced into the ballast 176 when the workhead is lowered, resulting in improper positioning of or even damage to the kicker arm assembly 98. This problem is avoided in the embodiment of FIG. 11 by connecting the pivot point of the arm 432 (i.e., the bracket 448) to the metal bar 424 of the ram assembly 396 such that the kicker arm 432 is positioned above the ballast 476 when the workhead is lowered, and is lowered into its operative position only when the metal bar 424 is lowered upon actuation of the ram assembly 396. The modified configuration of FIG. 11 also precludes interference between the pivot link and the top of the tie 344.

It should be understood that many changes and modifications could be made to the present invention without departing from the spirit and scope thereof. Such changes and modifications will become apparent from a reading of the appended claims.

What is claimed is:

1. An anchor removing machine for removing an anchor from a rail, said rail having a base having field and gauge sides, a head, and a vertical web connecting said head to said base, said anchor having a head engaging said gauge side of said base of said rail, a body extending transversely underneath said base of said rail, and a tail disposed adjacent said field side of said base of said rail, said anchor removing machine comprising:

A. a frame;

B. a ram assembly which is mounted on said frame, said ram assembly driving said tail of said anchor beneath said base of said rail;

C. a kicker assembly which is mounted on said frame, said kicker assembly being movable independently of said ram assembly, and said kicker assembly contacting said tail of said anchor to drive said tail transversely under said rail towards said gauge side of said rail; and D. a windrow assembly which is mounted on said frame, said windrow assembly movable independently of said ram assembly and said kicker assembly, and and said windrow assembly contacting said head of said anchor to drive said anchor transversely away from said gauge side of said rail.

2. An anchor removing machine as defined in claim 1, wherein said ram assembly, kicker assembly, and windrow assembly include first, second, and third hydraulic cylinders, respectively, and further comprising A. a hydraulic circuit which actuates each of said first, second, and third cylinders and which includes a pressurized fluid source;

B. first, second, and third valves located in said hydraulic circuit between said pressurized fluid source and said first, second, and third cylinders;

C. means for detecting a fully extended state of at least said first and second cylinders; and D. means, responsive to said means for detecting, for actuating said second and third valves such that said second cylinder is extended only when said means for detecting detects that said first cylinder is fully extended and, such that said third cylinder is extended only when said means for detecting detects that said second cylinder is fully extended.

3. An anchor removing machine as defined in claim 2, wherein said means for detecting comprises pressure switches.

4. An anchor removing machine for removing an anchor from a rail, said rail having a base having field and gauge sides, a head, and a vertical web connecting said head to said base, said anchor having a head engaging said gauge side of said base of said rail, a body extending transversely underneath said base of said rail, and a tail disposed adjacent said field side of said base of said rail, said anchor removing machine comprising:

A. a frame;

B. a ram assembly which is mounted on said frame, said ram assembly driving said tail of said anchor beneath said base of said rail;

C. a kicker assembly which is mounted on said frame, said kicker assembly driving said tail transversely under said rail towards said gauge side of said rail; and D. a windrow assembly which is mounted on said frame, said windrow assembly driving said anchor transversely away from said gauge side of said rail, wherein said ram assembly includes a guide sleeve;

a metal bar slidably received in said guide sleeve; and a cylinder; wherein said metal bar has an upper end connected to said cylinder and a lower end, said lower end being extendible from said sleeve and engaging said tail of said anchor upon extension of said cylinder.

5. An anchor removing machine as defined in claim 4, wherein said kicker assembly comprises A. a bracket having a first end connected to said metal bar and having a second end;

B. a cylinder; and

C. a kicker arm having a first end pivotally connected to said cylinder, an opposed second end for engaging said anchor, and a medial portion pivotally connected to said second end of said bracket, said second end of said kicker arm moving towards said rail upon extension of said cylinder.

6. An anchor removing machine for removing an anchor from a rail, said rail having a base having field and gauge sides, a head, and a vertical web connecting said head to said base, said anchor having a head engaging said gauge side of said base of said rail, a body extending transversely underneath said base of said rail, and a tail disposed adjacent said field side of said base of said rail, said anchor removing machine comprising:

A. a frame;

B. a ram assembly which is mounted on said frame, said ram assembly contacting said tail of said anchor to drive said tail beneath said base of said rail; and C. a kicker assembly which is mounted on said frame, said kicker assembly being movable independently of said ram assembly, and said kicker assembly driving said tail of said anchor to drive said tail transversely under said rail towards said gauge side of said rail, wherein said kicker assembly comprises a pivot link having a first end pivotally connected to said frame and having a second end;

a cylinder; and a kicker arm having a first end pivotally connected to said cylinder, an opposed second end for engaging said tail of said anchor, and a medial portion pivotally connected to said second end of said pivot link, said second end of said kicker arm moving towards said rail upon extension of said cylinder.

7. An anchor removing machine for removing an anchor from a rail, said rail having a base having field and gauge sides, a head, and a vertical web connecting said head to said base, said anchor having a head engaging said gauge side of said base of said rail, a body extending transversely underneath said base of said rail, and a tail disposed adjacent said field side of said base of said rail, said anchor removing machine comprising:

A. a frame;

B. a ram assembly which is mounted on said frame, said ram assembly contacting said tail of said anchor, and said ram assembly driving said tail of said anchor beneath said base of said rail; and C. a windrow assembly which is mounted on said frame, said windrow assembly being movable independently of said ram assembly, and said windrow assembly contacting said head of said anchor to drive said anchor transversely away from said gauge side of said rail, wherein said windrow assembly comprises a pivot link having a first end pivotally connected to said frame and having a second end;

a cylinder; and a windrow tool having a first end pivotally connected to said cylinder, an opposed second end for engaging said anchor, and a medial portion pivotally connected to said second end of said pivot link, said second end of said windrow tool moving away from said rail upon extension of said cylinder to contact said head of said anchor and drive said head transversely away from said gauge side of said rail.

8. An anchor removing assembly as defined in claim 7, further comprising a stop on which rests said cylinder.

9. An anchor removing assembly s defined in claim 8, wherein said stop is adjustable.

10. An anchor removing machine for removing first and second anchors from a rail, said rail having a base having field and gauge sides, a head, and a vertical web connecting said head to said base, said anchors being located on opposed sides of a tie, each of said anchors having a head engaging said gauge side of said base of said rail, a body extending transversely underneath said base of said rail, and a tail disposed adjacent said field side of said base of said rail, said anchor removing machine comprising:

A. a workhead;

B. means for lowering said workhead onto said rail;

C. first and second anchor removing assemblies each of which is mounted on said workhead so as to be movable longitudinally with respect to said rail;

D. first and second stops for engaging said first and second anchors, each of said stops being mounted on one of said anchor removing assemblies; and E. a boxing cylinder which drives said first and second anchor removing assemblies towards one another such that said first and second stops engage said first and second anchors.

11. An anchor removing machine as defined in claim 10, wherein each of said anchor removing assemblies includes A. a carriage;

B. a ram assembly which is mounted on said carriage and which drives said tail of one of said anchors beneath said base of said rail;

C. a kicker assembly which is mounted on said carriage, which engages said tail of said one anchor, and which drives said tail transversely under said rail towards said gauge side of said rail; and D. a windrow assembly which is mounted on said carriage, which engages said head of said one anchor, and which drives said one anchor transversely away from said gauge side of said rail.

12. An anchor removing machine as defined in claim 11, wherein

A. said ram, kicker, and windrow assemblies include first, second, and third cylinders which actuate said ram assembly, said kicker assembly, and said windrow assembly, respectively;

B. each of said ram assemblies further comprises a guide sleeve and a metal bar slidably received in said guide sleeve, said metal bar having an upper end connected to said first cylinder and a lower end which is extendible from said sleeve and which engages said tail of said one anchor;

C. each of said kicker assemblies further comprises (1) a kicker arm having a first end pivotally connected to said second cylinder, an opposed second end for engaging said one anchor, and a medial portion pivotally connected to another portion of said anchor removing machine, said second end moving towards said rail upon extension of said second cylinder; and wherein D. each said windrow assemblies further comprises (1) a pivot link having a first end pivotally connected to said carriage and having a second end; and (2) a windrow tool having a first end pivotally connected to said third cylinder, an opposed second end for engaging said one anchor, and a medial portion pivotally connected to said second end of said pivot link, said second end moving away from said rail upon extension of said third cylinder.

13. An anchor removing machine as defined in claim 12, further comprising A. a fourth cylinder for driving said first and second anchor removing assemblies towards one another;

B. a clamp assembly mounted on said workhead;

C. a fifth cylinder for actuating said clamp assembly so as to apply a clamping force said rail;

D. a hydraulic circuit which actuates each of said first, second, third, fourth, and fifth cylinders and which includes a pressurized fluid source;

E. first, second, third, fourth, and fifth valves located in said hydraulic circuit between said pressurized fluid source and said first, second third, fourth and fifth cylinders, respectively;

F. means for detecting a fully extended state of at least said first, second, fourth, and fifth cylinders; and G. control means, responsive to said means for detecting, for actuating said first, second, third, and fifth valves such that (1) said fifth cylinder is extended only when said means for detecting detects that said fourth cylinder is fully extended, (2) said first cylinder is extended only when said means for detecting detects that said fifth cylinder is fully extended, (3) said second cylinder is extended only when said means for detecting detects that said first cylinder is fully extended, and such that (4) said third cylinder is extended only when said means for detecting detects that said second cylinder is fully extended.

14. An anchor removing machine as defined in claim 10, further comprising adjustable stops which are mounted on said first and second anchor removing assemblies and which limit movement of said first and second anchor removing assemblies towards one another in the absence of at least one of said first and second anchors.

15. A method of removing an anchor from a rail, said anchor having a head and a tail disposed on gauge and field sides of said rail, respectively, said method comprising:

A. actuating a ram assembly, mounted on a frame of an anchor removing machine, to contact and drive said tail of said anchor beneath a base of a rail; then B. actuating a kicker assembly, mounted on said frame, to contact and drive said tail transversely under said rail towards a gauge side of said rail; and then C. actuating a windrow assembly, mounted on said frame, to contact and drive said head of said anchor transversely away from said gauge side of said rail.

16. A method of removing a pair of spaced anchors from a rail, said method comprising:

A. lowering a workhead onto said rail, said workhead having first and second anchor removing assemblies mounted thereon;

B. automatically centering said workhead with respect to a longitudinal centerline of said rail upon the lowering of said workhead onto said rail;

C. automatically aligning said first and second anchor removing assemblies with said first and second anchors by moving said first and second anchor removing assemblies longitudinally with respect to said rail, wherein said aligning step comprises driving stops into engagement with outer lateral surfaces of said anchors; and D. removing said first and second anchors using said first and second anchor removing assemblies.

17. A method as defined in claim 16, wherein said centering step comprises engaging a head of said rail with a plate mounted on one of said anchor removing assemblies.

18. A method as defined in claim 16, wherein said step of removing, in the case of each of said anchors, comprises:

A. actuating a ram assembly of one of said anchor removing assemblies to drive said tail of the anchor beneath said base of said rail;

B. actuating a kicker assembly of said one anchor removing assembly to engage said tail of said anchor and to drive said tail transversely under said rail towards a gauge side of said rail; and C. actuating a windrow assembly of said one anchor removing assembly to engage a head of said anchor and to drive said anchor transversely away from said gauge side of said rail.

19. An anchor removing machine for removing an anchor from a rail, said rail having a base having field and gauge sides, a head, and a vertical web connecting said head to said base, said anchor having a head engaging said gauge side of said base of said rail, a body extending transversely underneath said base of said rail, and a tail disposed adjacent said field side of said base of said rail, said anchor removing machine comprising:

A. a frame;

B. a ram assembly which is mounted on said frame, said ram assembly contacting said tail of said anchor, and said ram assembly driving said tail of said anchor beneath said base of said rail;

C. a windrow assembly which is mounted on said frame, said windrow assembly being movable independently of said ram assembly, and said windrow assembly including a windrow tool which contacts said head of said anchor to drive said anchor transversely away from said gauge side of said rail, wherein said ram assembly includes a first drive for effecting movement of said ram assembly without moving said windrow assembly, and wherein said windrow assembly includes a second drive for effecting movement of said windrow assembly without moving said ram assembly.

20. An anchor removing machine as defined in claim 19, wherein said first drive comprises a first cylinder and said second drive comprises a second cylinder.

21. An anchor removing machine as defined in claim 20, wherein said windrow tool is pivotably connected to said second cylinder and has an end which moves away from said rail upon extension of said second cylinder to contact said head of said anchor and to drive said head transversely away from said gauge side of said rail.

22. An anchor removing machine as defined in claim 21, wherein said windrow tool has first and second ends with said second end contacting said head of said anchor, and wherein said second cylinder is pivotably connected to said first end, and said windrow assembly further comprises a pivot link having a first end pivotally connected to said frame and a second end pivotably connected to said windrow tool at a location between said first and second ends.

* * * * *